US005157852A

United States Patent [19]

Patrou et al.

[11] Patent Number: 5,157,852

[45] Date of Patent: Oct. 27, 1992

[54] THREE DIMENSIONAL PAPER STRUCTURE ENCLOSED IN A TRANSPARENT BOX

[76] Inventors: Louis G. Patrou, 7456½ Waring Ave.; John D. Phelps, 1432 N. Formosa Ave. #2, both of Los Angeles, Calif. 90046

[21] Appl. No.: 697,919

[22] Filed: May 2, 1991

Related U.S. Application Data

[63] Continuation of Ser. No. 556,802, Jul. 23, 1990, abandoned.

[51] Int. Cl.[5] ..... G09F 1/00

[52] U.S. Cl. ..... 40/160; 40/124.1

[58] Field of Search ..... 40/160

[56] References Cited

U.S. PATENT DOCUMENTS

| | | | |
|---|---|---|---|
| 2,314,721 | 3/1943 | Lowenstein | 40/160 X |
| 3,057,099 | 10/1962 | Fruchter | 40/160 |
| 3,503,147 | 3/1970 | Herrin et al. | 40/160 |
| 3,826,498 | 6/1974 | Bosshard | 40/160 |
| 3,829,998 | 8/1974 | Flax | 40/160 |

*Primary Examiner*—Laurie K. Cranmer
*Assistant Examiner*—Cassandra Hope

[57] ABSTRACT

A three-dimensional sculpture comprised of a product in the family of paper, the sculpture being comprised of a generally vertical background; a platform extending at an angle from the background; a plurality of characters attachable to at least the platform such the background, platform and characters form a three dimensional sculpture from front, side and angled views thereof.

1 Claim, 5 Drawing Sheets

FIG. 1
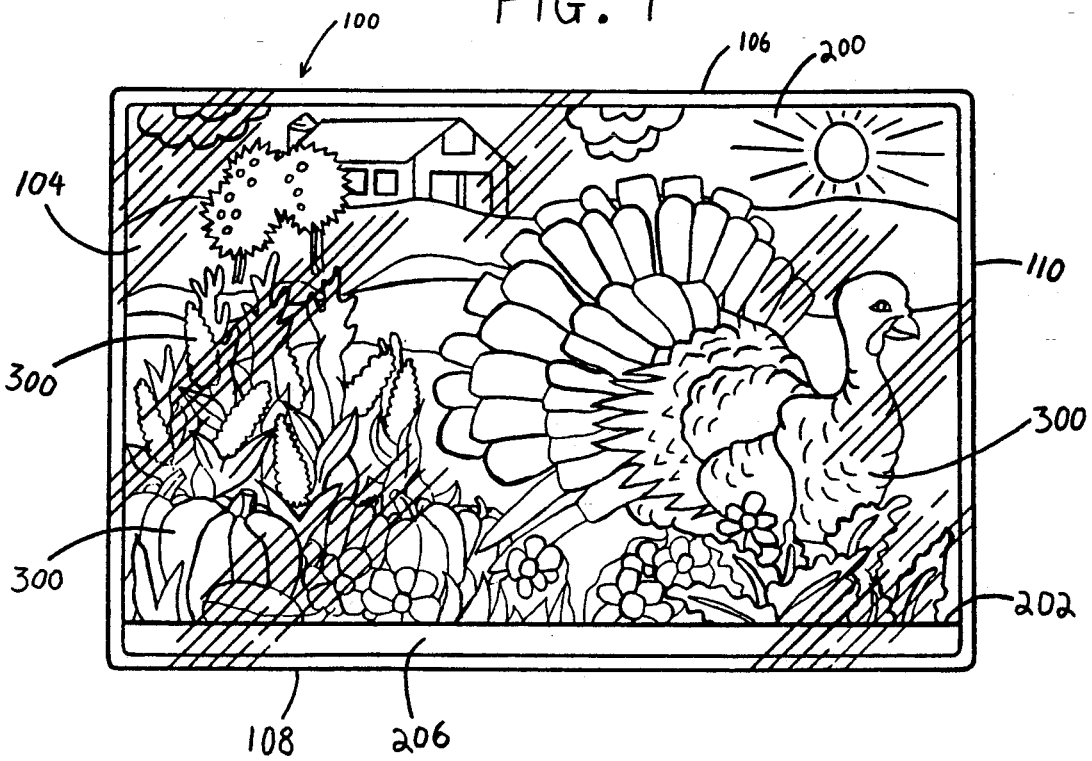
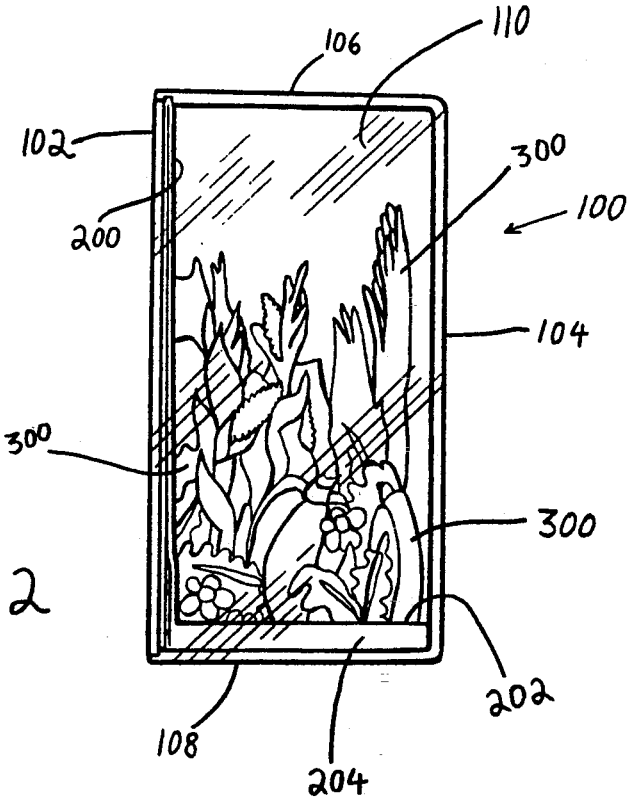
FIG. 2

FIG. 5
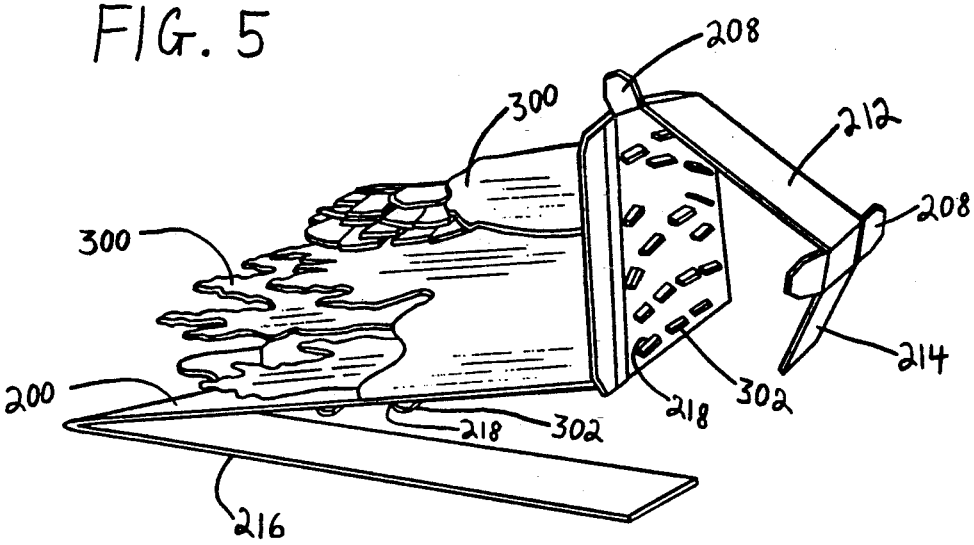
FIG. 6
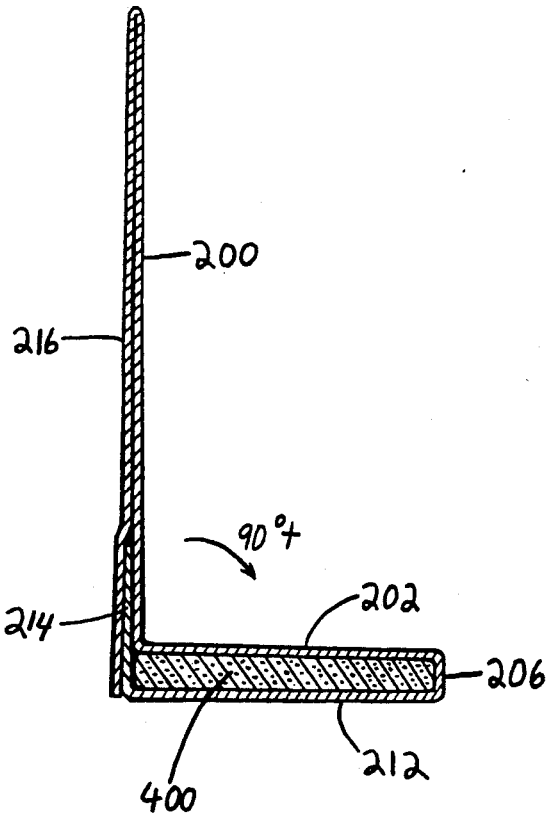
FIG. 7A
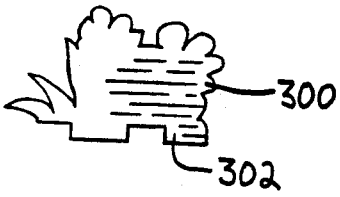
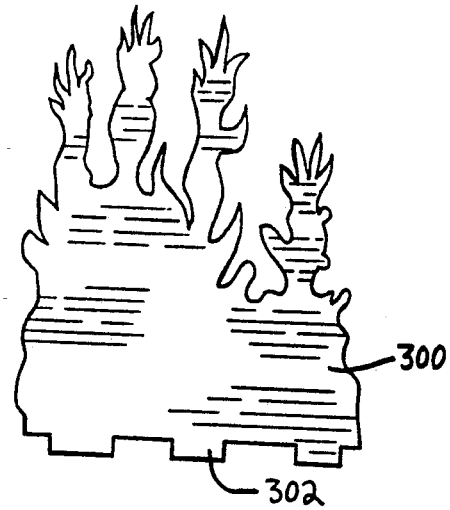
FIG. 7B

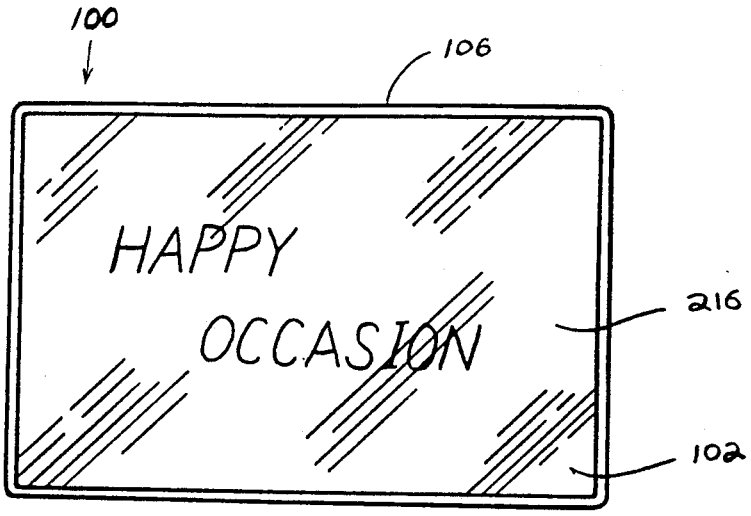
FIG. 8
FIG. 9
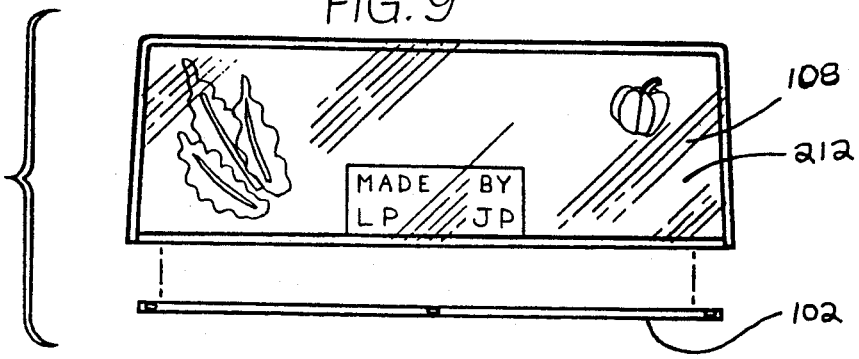
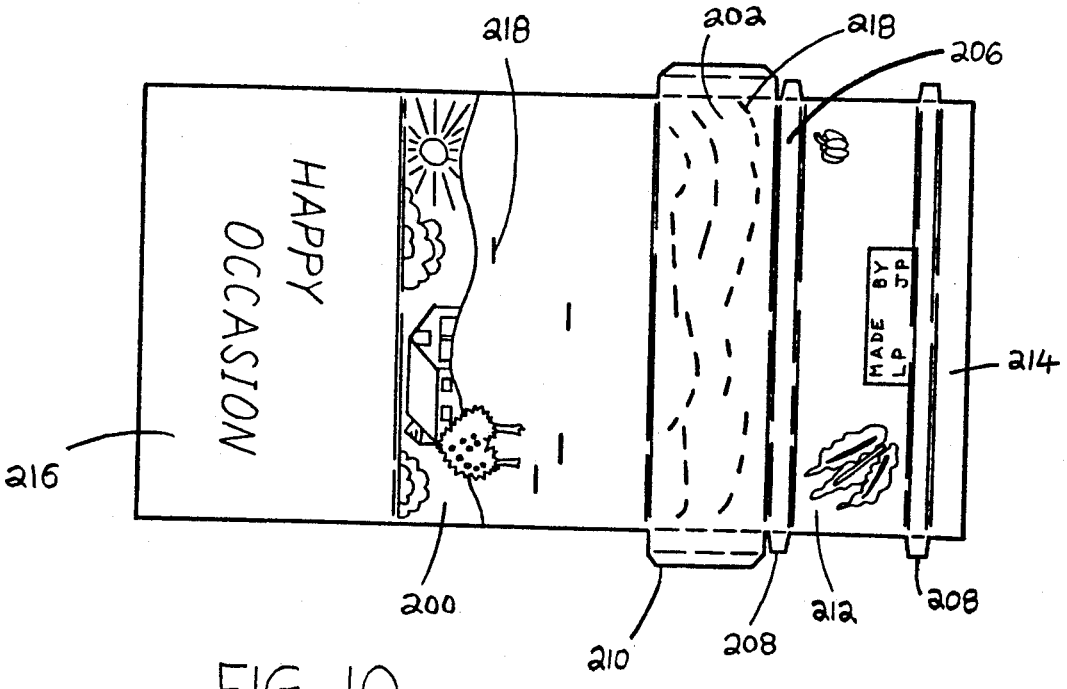
FIG. 10

THREE DIMENSIONAL PAPER STRUCTURE ENCLOSED IN A TRANSPARENT BOX

CROSS REFERENCES

This is a continuation of co-pending application Ser. No. 07/556802 filed Jul. 23, 1990, now abandoned.

BACKGROUND OF THE INVENTION

Well known in the art are pop-cards and pop-books in which pictures are transformed from a flat scene to a three-dimensional embodiment. In the typical pop-card, a card is folded flat for insertion into an envelope. When the card is opened, a plurality of figures "pop up" from the background. Each of the figures are generally cut from a singular piece of paper attached at various points on the card back. When the card is opened, these figures pop up in different planar positions. The figures are interlinked to one another by the singular base from which they are cut and are cut out of one another. The company Popshots, Inc. in Westport, Conn. is a manufacturer and designer of such cards. The problem with these cards is that each figure is cut out from a preceding figure and is flat. Thus, the shoulder of one figure will result in that section being cut out of a figure which stands behind it. This means that while the pop-up card is three-dimensional in view from a front perspective, if one looks at an angle at the pop-up picture or from the side, what is seen instead, is a plurality of edges from the figures and the connections therebetween. Also seen from a non frontal view is the fact that each figure is cut out from the other figures. Accordingly, the pop-up card obtains its three-dimensional affect only from a front view and each figure exists at the expense of another figure.

Similar three-dimensional creations are seen in French Patent No. 1,003,933 issued to Carliez, U.S. Pat. No. 2,577,320 issued to Fenyo, U.S. Pat. No. 2,984,920 issued to Acosta, U.S. Pat. No. 2,203,578 issued to Podmore, U.S. Pat. No. 3,503,147 issued to Herrin, and U.S. Pat. No. 3,829,998 issued to Flax. In all of these references, three-dimensional structures are disclosed from a front view only. The dimensionality of the structures in these instances is obtained by decorating plurality of flat layers and locating them in spaced relationship to one another in a container. As an example, in the Herrin patent, the back opaque wall of a display device is decorated and the front transparent wall is decorated. The two walls are situated in spaced relationship to one another and in a front on view, the effect of three-dimensionality is achieved.

In the Podmore reference, a plurality of walls are decorated and interlinked at their edges, the walls are spaced from one another to again provide the front view three-dimensional effect described above.

In these patents, as well as in the pop-up card, the viewer really does not obtain any sort of three-dimensional perspective when looking at the invention from anything other than a front on view.

U.S. Pat. No. 2,314,721 to Lowenstein also discloses a diorama construction. While this patent also fails to disclose a three-dimensional situation in which one can view the scene from anything other than a front view, it does differ from the other patents. In this reference, separate pieces of the scene are glued in spaced relationship to one another on a flat platform. In this way, from a front view, one obtains a three-dimensional view of the scene because of the spaced relationship of the different pieces to one another.

The present invention is an improvement over these prior art devices disclosing a three-dimensional paper structure which may be viewed from at least the sides and the front and which is housed in a largely transparent box. The connections between the various pieces is not readily apparent to the viewer from most views and these connections are accomplished either by known means of gluing or by a secure and hidden insertion of the figures in the platform on which they stand, in each other, or in the background. The figures are not necessarily flat, and in fact may be three dimensional in shape themselves.

SUMMARY OF THE INVENTION

Disclosed herein is a three-dimensional sculpture comprised of a product in the family of paper, said sculpture being comprised of a generally vertical background; a platform extending at an angle from said background; a plurality of characters attachable to at least said platform such that said background, platform and characters form a three dimensional sculpture from front, side and angled views thereof.

BRIEF DESCRIPTION OF THE DRAWINGS

A preferred embodiment of the present invention may be seen in the following figures.

FIG. 1 is a front view of the invention as housed in a transparent box of the invention.

FIG. 2 is a side view of the invention housed in the transparent box.

FIG. 5 is a perspective view of the invention showing the connections between upstanding figures and the L-shaped base upon which they are mounted.

FIG. 6 is a side view of the L-shaped platform partially in section showing the manner in which the platform folds together and the styrofoam is inserted therein.

FIGS. 7A and 7B show some of the singular pieces of the invention in a flat form with connecting tabs.

FIG. 8 a back view of the invention within the transparent box of the invention.

FIG. 9 is a bottom view of the invention within the transparent box.

FIG. 10 is a flattened view of the L-shaped base upon which the singular pieces are placed.

DETAILED DESCRIPTION OF THE INVENTION

Figure 3:
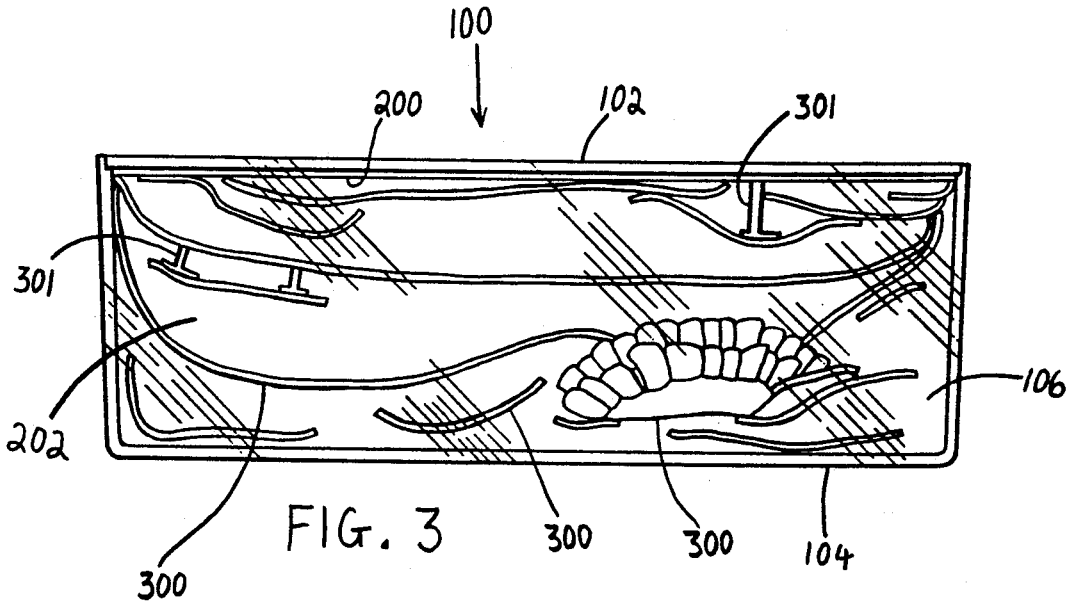
FIG. 3 is a top view of the invention looking through the transparent box.

Seen in FIGS. 1, 2, and 3 is transparent box 100 housing a three-dimensional scene. This three-dimensional scene is comprised of vertical background 200 which is connected to horizontal platform 202 upon which are found singular characters 300. Background 200 is seen to stand vertically in transparent box 100 and to be in L-shaped connection with platform 202 thereby forming the basic L-shaped unit of the artistic structure. Transparent box 100 is seen to be generally rectangular in shape and transparent on all sides. As can be seen from FIG. 1, singular characters 300 are comprised of a turkey, flowers, corn stalks, pumpkins, and hillsides. The background 200, is painted with a scene of a farmhouse, trees, and rolling hills. As better seen in FIGS. 2 and 3 and which are respectively, a side view of the invention and a top view of the invention, characters 300 are not necessarily flat. In their positioning on platform 202 they arc from the front to the back, bend and wave, and generally provide a three dimensional scene and a picturesque scene from the sides as well as from the front. The connections between characters 300, between characters 300 and background 200, and between characters 300 and platform 202 are not readily perceivable from a front, angled or side view of the box 100 although they are perceivable in this instance from the top view. In FIG. 3, several of the connections are marked as 301. These connections could be masked from the top view by bending the character thereover. An instance of this is seen in FIG. 3 where the turkey feathers bend and mask from all sides any connection the turkey character might have.

As can be seen in FIGS. 2 and 3, the characters 300 are placed in spaced relationship to each other so that the compilation of L shaped base and characters depicts a scene in three dimensional form. While in FIGS. 1 and 2 most of the characters are two dimensional, they could be three dimensional.

Turning again to FIGS. 2 and 3, it will be noted that transparent box 100 is not comprised strictly of right angles. It is comprised of vertical back 102, vertical front 104 spaced from vertical back 102, top 106 interconnecting the upper edges of back 102 and front 104, sides 110 interconnecting the side edges of back 102 and front 104, and connecting to the side edges to top 106, and base 108 lying opposite top 106 and interconnecting the bottom edges of back 102 and front 104 and sides 110. Back 102 may be seen to be slightly greater in height than front 104. This causes top 106 to slope downwardly from back 102 to front 104. In contrast base 108 does not slope but forms right angles with both back 102 and front 100 so that the box 100 may properly rest on base 108 without additional support. Back 102 is also slightly wider than front 104 so that sides 110 angle inwardly from back 102 to front 104. The edges of box 100 are rounded as are the corners and back 102 is snap fastened or otherwise removably attached to the rest of box 100 to enable insertion of the three dimensional paper structure disclosed herein. FIG. 9 should be reviewed in this regard. This figure shows back 102 separated from the rest of box 100.

Box 100 is constructed in the angled fashion discussed above for two reasons. First, it facilitates injection molding of the plastic box so that the mold may be easily removed from the interior of the box. Second, it facilitates maintaining background 200 and platform 202 in their L-shaped configuration.

Also well seen in FIG. 2 is that platform 202 comprises itself a rectangular box although it could as well be flat. Discussing platform 202 as a rectangular box, in FIGS. 1 and 2, platform 202 has front edge 206 which abuts front face 104 of transparent box 100 and extends normally to platform 202. It also has side edges 204 which abut sides 110 of transparent box 100 and which are also located normally with respect to platform 202.

Figure 4:
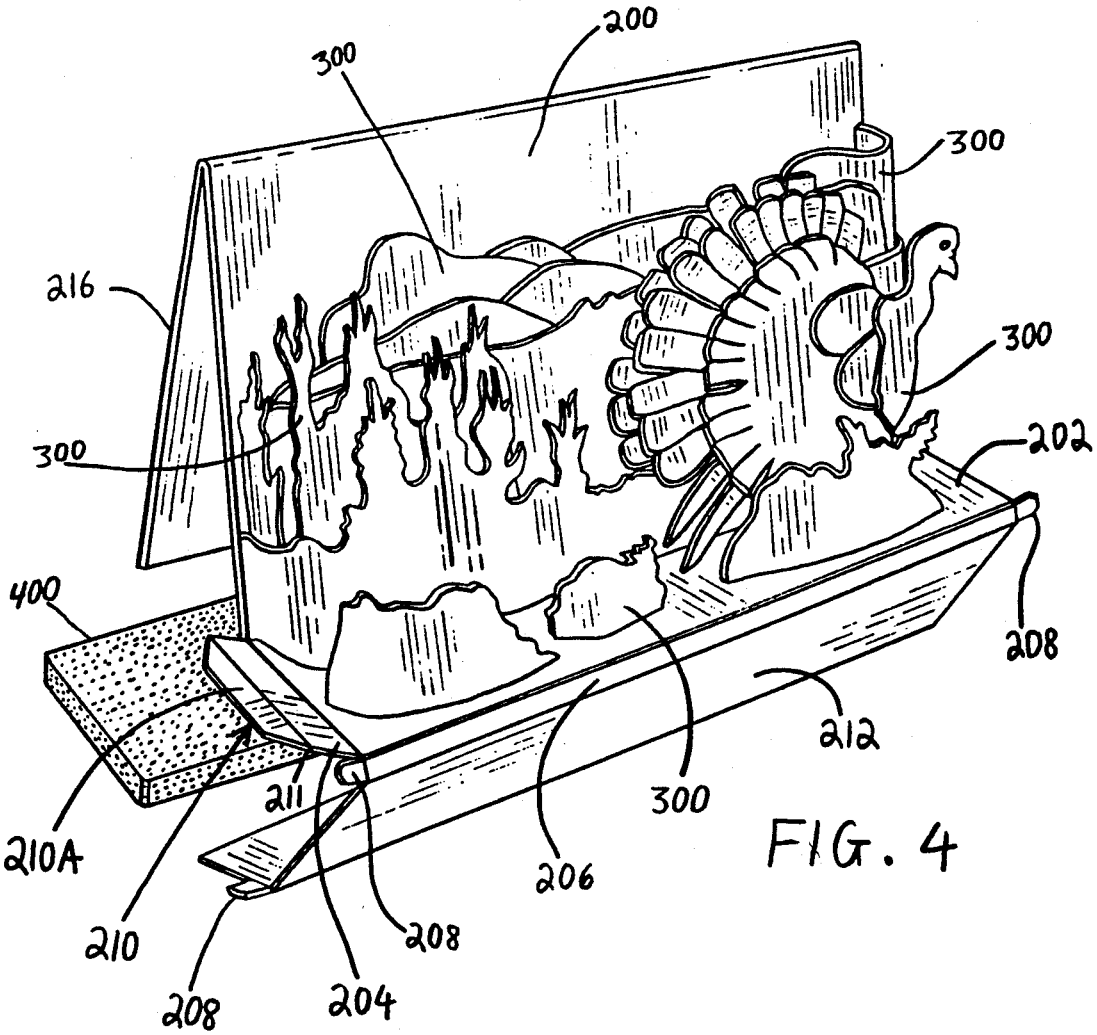
FIG. 4 is a view of the invention outside of the translucent box and in a partially disassembled condition.

FIG. 4 shows in partially broken apart form L-shaped background 200 and platform 202 with the characters thereon. The three-dimensional structure is here separated from transparent box 100. The rectangular structure formed from platform 202 opens in standard box type fashion with edge tabs 208 and flaps 210. Flaps 210 have folds 211 in them to form side edge 204 and to fold downwardly into the hollow formed by the rectangular box made by platform 202. In FIG. 4 it is seen that front edge 206 attaches to bottom 212 which in its folded form will lie parallel with platform 202 and at right angles to front edge 206 and side edge 204. Thus, as the outer portion 210a of flaps 210 folds inside the rectangular box formed by platform 202, bottom 212 covers these outer flaps 210a. Since bottom 212 lies flush against the base 108 of transparent box 100, its covering of flaps 210 is most advantageous. This means that bottom 212 can be decorated and will present an attractive and finished side upon which pictures can be placed so that the viewer and owner of the box may turn the box upside down and see a decoration. FIG. 9 may be reviewed in this respect. It will also be noted from FIG. 4 that bottom 212 connects to back securing edge 214. Securing edge 214 forms a back edge which is opposite the front edge 206 of platform 202 and a lip which rests against the backside of background 200. FIGS. 5 and 6 may be reviewed to better appreciate this relationship.

From FIGS. 4, 5, and 6, it may be seen that background 200 attaches to back flap 216. Back flap 216 connects to and extends from the top of background 200 and to the position where bottom 212 is positioned. Back flap 216 is almost identical in size to background 200 so that it folds against the rear side of background 200 and covers the connection between the rear side of background 200 and securement flap 214. In this fashion, back flap 216 may be decorated as may bottom 212 and present a nice clean appearance for the viewer. The reader may wish to review FIG. 8 where drawings of the rear view of transparent box 100 with back flap 216 showing through. It can be seen that this view as the view of the bottom of the invention in FIG. 9, is a finished view without tabs or connections being shown.

Studying in more depth FIGS. 3, 4 and 5, it may be seen that characters 300 connect to each other, to platform 202 and to background 200. Their connections are made in various fashions. They may be connected by gluing and pasting if such connection will be unobvious in the ultimate scene and efficient in the manufacture of the design. In such an instance the characters themselves may be bent in an L shape with the foot of the L being attached to another part, or may have L shaped tabs extending from them again with the foot of the L being glued to another part. In FIG. 3, one attachment 301 is comprised of foam pieces glued to the back of the character and then to the back ground. Any sort of attachment is within the contemplation of this invention to achieve the necessary three-dimensional effect. A spring or transparent plastic might be used. However, preferably, the characters 300 are connected through slots 218 in other characters, in the background 200, and platform 202. In FIG. 5 the slits or slots 218 in background 200 and platform 202 is seen. These slots or slits 218 may be in any shape desired to effect the bending or curving of the characters. Thus some of the slots 118 may be in the form of an arc or angle. Through these slots or slits 218, tabbed portions 302 of the characters extend. These tabs 302 may be bent flush against the underside of background 200 and platform 202 and glued or secured in place. Their connection is covered by bottom 212 and back flap 216. If platform 202 is flat and merely comprised of platform 202, base 212, and securement means 214, then base 212 also helps to secure these tabs in place by pressing thereagainst. Similarly, back flap 216 helps to secure the tabs protruding through background 200 in place by pressing thereagainst. On the other hand, and as discussed above, if platform 202 is not formed of a flat piece but forms a small hollow rectangle, then this rectangle may be filled with a material such as styrofoam or foam 400. The tabs 302 penetrate the styrofoam or foam 400 and for extra securement may be glued in place within the styrofoam or foam 400. The styrofoam or foam 400 holds the tabs 302 and therefore the characters 300 in position. Styrofoam or foam 400 is seen in FIG. 4 to be a rectangular block which fits in one piece within the hollow defined by platform 202 when forming a rectangular box. The slots 218 which appear in platform 202 may be made when constructing platform 202 or may be made after construction so that styrofoam 400 is slotted at the same time. It is noted then that back flap 216 as well as bottom 212 not only cover the connection of characters 300 to L-shaped background 200 and platform 202 as well as cover the connections of securement flaps 214, edge tabs 208, and flaps 210 and tabs 302, but also act to strengthen background 200 and bottom 212. Further, since back flap 216 does not lie flush against the rear side of background 200 due to the presence of securement flap 214, a slight angle is formed between back flap 216 and background 200 which facilitates its locking in place in transparent box 100. This may be seen in FIG. 6 which is a sectional view of the L-shaped background 200 and platform 202 with styrofoam or foam 400 inserted in the hollow formed by platform 202 and its co-pending sides.

In FIGS. 7A and 7B, some of the characters shown in the preceding figures are shown in their unbent and unattached state. The characters contain tabs 302 for securement into the platform 202, each other, and background 200. The characters may be two-dimensional or three-dimensional and connected to each other, the platform or the background or any combination thereof.

Figure 11:
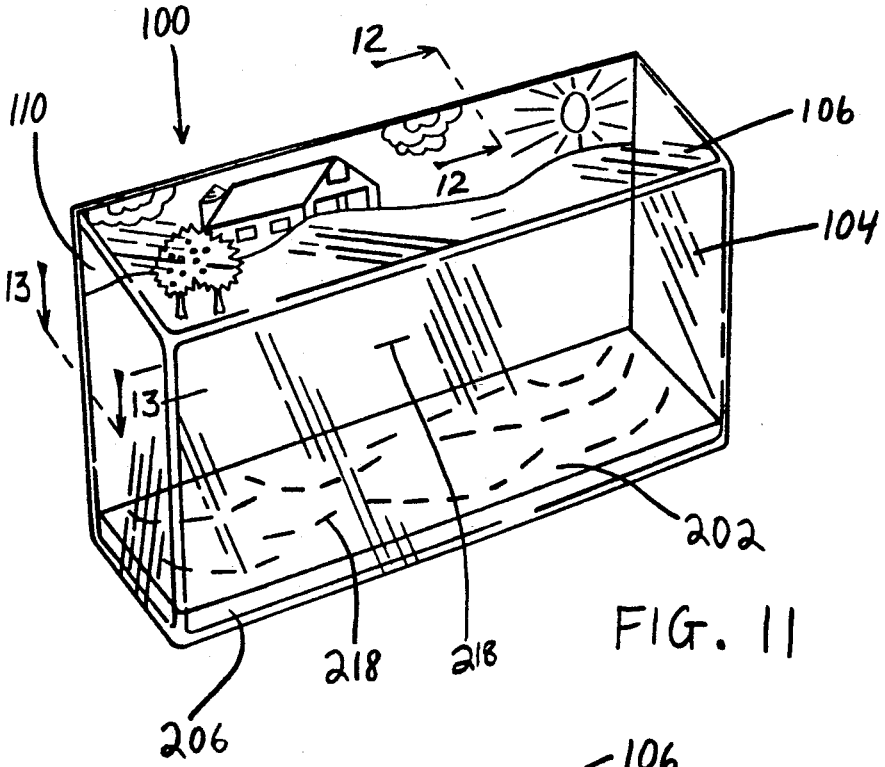
FIG. 11 is a perspective view of the L-shaped base in its folded form and in the transparent box.

FIG. 10 is a revealing figure showing that back flap 216, background 200, platform 202, front edge 206, bottom 212, securement flap 214, flap 210, and edge tabs 208 are all integrally formed from one largely rectangular piece. This piece is scored or folded to create the different sections before described. Also, slots or slits 218 are clearly seen in platform 202 and background 200. Thus, one can appreciate that the support for characters 300 is made by folding the rectangular piece shown in FIG. 9 into the parts described above. Background 200 as well as platform 202 are themselves painted with pictures to assist in the depiction of a three-dimensional scene in the box once the characters 300 have been added. After folding the piece of FIG. 10, styrofoam 400 may be inserted into the rectangular box formed by platform 202 and its co-pending sides. The characters 300 then may be inserted into the slots formed in the background 200, platform 202, or each other to form the three-dimensional structure. In FIG. 11, construction of the base L-structure formed from the rectangular piece of FIG. 10 has been accomplished and the structure placed in transparent box 100. Slots or slits 218 are well seen in this figure in platform 202.

Figure 12:
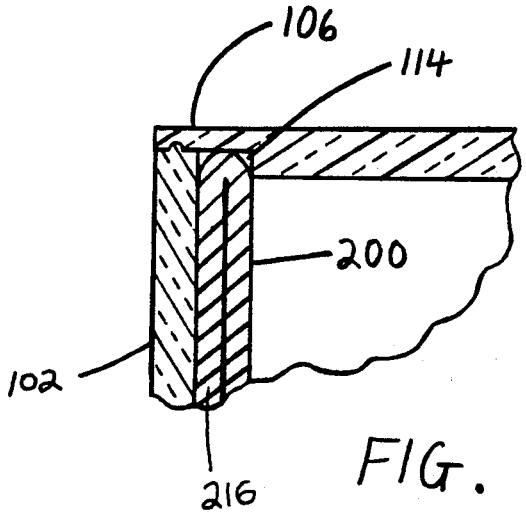
FIG. 12 is a sectional view of the transparent box showing the ceiling groove and the interconnection between the removable back of the transparent box and the top of the transparent box.
Figure 13:
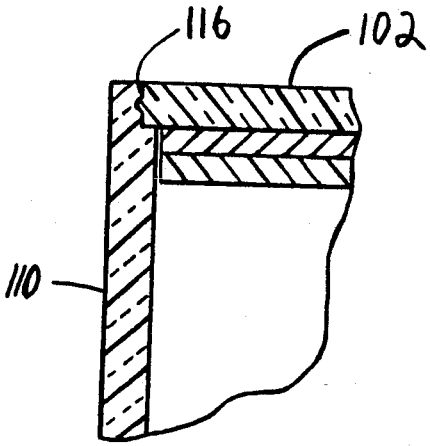
FIG. 13 is a sectional view of the transparent box showing the side groove.

FIG. 12 shows a sectional view of the transparent box 100 through 12—12 of FIG. 11. This view is provided to show top groove 114 in the top inside surface of top 106 near back 102. Top groove 114 receives both the top edge of background 200 where background 200 creates a fold with back flap 216 and the top edge of back 102. Groove 114 may be compared with side groove 116 shown in FIG. 13. FIG. 13 is a sectional view of box 100 take along line 13—13 in FIG. 11. Side groove 116 is notably not as large as hop groove 114 as it only accommodates the side edge of back 102. Side groove 116 is formed in the back edge of side 110 to enable back 102 to be snapped into sides 110 as well as top 106 and base 108. FIG. 9 shows back 102 separated from this "snapped-in" position.

Top groove 114 facilitates holding background 200 in an L-shaped configuration with respect to platform 202. However, it is only preferably included and in fact, background 200 does not need to rest within a groove.

From the foregoing it can be appreciated that the present invention is very unusual in disclosing a three-dimensional paper structure housed in a transparent box. This structure may be viewed from at least the front and at an angles therearound and provide the viewer with a three-dimensional scene. In this disclosure, the scene presents scenic three-dimensional views from the front and sides and even the top with minor character manipulation. The structure is attractive from all sides and for that reason may be contained in a fully transparent box. The characters are connected into a generally L-shaped background as well as into each other, and do not result from being cut from one another. The characters may be two or three-dimensional, flat, or curved. The final product is a very attractive three-dimensional picture structure made of paper or cardboard and housed if desired in a transparent box.

To summarize and specify the foregoing, the basic L-shaped unit is comprised of one piece of paper, cardboard or the like. The color of this unit is optional and it may be scored, printed, folded, curved or dye cut to facilitate its folding into the L-shape and accepting characters with attachment means. If paper is used, the stock thickness may vary. The scoring and folding, as noted, facilitates creating the horizontal box platform area which is at the foot of the L-shaped unit and the connecting vertical back wall or background 200 of the L-shaped unit. The horizontal box platform 202 may or may not have a foam pad 400 or other holding means inserted therein. The floor of the platform 202 may have dye-cut or hand-cut slits/slots 218 to hold angled, curved, three-dimensional, or flat scene elements 300. The background wall area 200 with its back flap 216 that fastens to the background wall 200 provides the finished back view. The box platform 202 which forms the base also fastens to itself to form neat side, bottom and top views. The loose pieces 300 may be inserted into the slots/slits 218 formed in the background wall 200 and platform 202 and other pieces, by means of tabs 301, 302 connected thereto or may be cemented to the background walls or platform 202. The pieces 300 may also be secured to the front 206, side, and back edges of platform 200 to aid in the three dimensionality of the scene or to cover connecting means. The pieces may even hang from the top of the scene with proper connections being made to the basic L-shaped unit or to other pieces 300. These pieces 300 will be printed on one or both sides and may be scored, printed, folded, curved or manipulated in any desired fashion to obtain the desired three-dimensional look.

Foam pad or other insert 400 for the foot of the L-shaped unit may be cemented within the box platform area. The insert may also be die-cut to receive and stabilize the loose pieces 300 and may be made from point 25" polyethylene foam or similar workable material.

The clear housing 100 in which the artistic three-dimensional invention is encased may be comprised of clear, semi-clear, or opaque five-sided injection molded plastic. As noted above, the housing walls may have a slight draft and the corners may have a slight radius. The housing back 102 may be snapped, cemented, or hinged in place to complete the housing enclosure. This back may be made of a clear, semi-clear or opaque injection molded or sheet plastic material or may be made of chipboard or paper. In such an instance, the back flap 216 of the basic L-shaped unit would not have to be designed and in fact, would not necessarily have to be included. However, its inclusion is helpful in strengthening the back structure and fastening any tab portions 302 which extend through slots/slits 218 in the basic L-shaped structure.

It is understood that the present invention could also contain moving parts, photocells, and other devices. It is suggested that the plastic box 100 which encases the three-dimensional structure contain a groove 114 for receipt of the background wall 200 which serves as the background of the structure. This groove will hold the structure in its basic L-shaped shape. The present invention is claimed as follows.

We claim:

1. A display device comprising:

a three-dimensional transparent housing having sides and a sculpture formed from paper products enclosed within said housing, said sculpture comprising a single sheet folded into a plurality of panels.

said sheet having a first vertical panel having a bottom edge and a top edge, said first panel disposed adjacent to a rear side of said housing, a second vertical panel connected to said top edge of said first panel along a first fold line and disposed in a generally vertical parallel relationship to said first panel, a third generally horizontal panel having a forward, a rear, a left side edge, and a right side edge, said rear edge of said third panel connected to a second panel along a second fold line in a generally perpendicular relationship, said forward edge of said third panel connected to a fourth vertical panel in perpendicular relationship along a third fold line, a fifth horizontal panel having a forward and a rear edge, said forward edge of said fifth panel connected to said fourth panel in a perpendicular relationship along a fourth fold line, said fifth panel extending such that said rear edge of said fifth panel meets with said bottom edge of said first panel, a sixth and a seventh vertical panel connected to said right and left side edges, respectively, of the third panel in a perpendicular relationship such that the first, third, fourth, fifth, sixth and seventh panels form a generally rectangular base structure, means for securing a plurality of characters to at least said second and third panels, indicia adapted to be disposed on said characters, a foam-like material disposed within said rectangular base structure, such that said characters are visible from all sides of said housing except the rear and a bottom side of said housing, and indicia disposed on first, second, third, fourth, fifth, sixth, and seventh panels such that indicia is visible from all sides of said transparent housing.

* * * * *